US009761382B2

(12) United States Patent
Stanton et al.

(10) Patent No.: US 9,761,382 B2
(45) Date of Patent: Sep. 12, 2017

(54) SWITCH AND ASSOCIATED METHODS

(71) Applicant: REL Developments Limited, Watford Hertfordshire (GB)

(72) Inventors: Christopher John Stanton, Stowmarket Suffolk (GB); John William Chester, Kennett Suffolk (GB); Hong Wen Jiang, Southampton Hampshire (GB)

(73) Assignee: REL DEVELOPMENTS LIMITED, Watford, Hertfordshire (GB)

( * ) Notice: Subject to any disclaimer, the term of this patent is extended or adjusted under 35 U.S.C. 154(b) by 0 days.

(21) Appl. No.: 14/773,086

(22) PCT Filed: Mar. 7, 2014

(86) PCT No.: PCT/GB2014/050689

§ 371 (c)(1),
(2) Date: Sep. 4, 2015

(87) PCT Pub. No.: WO2014/135898

PCT Pub. Date: Sep. 12, 2014

(65) Prior Publication Data

US 2016/0020042 A1 Jan. 21, 2016

(30) Foreign Application Priority Data

Mar. 8, 2013 (GB) ..... 1304224.7

(51) Int. Cl.
*H01H 1/58* (2006.01)
*H01H 50/64* (2006.01)
(Continued)

(52) U.S. Cl.
CPC ..... *H01H 1/5822* (2013.01); *H01H 50/642* (2013.01); *H01H 1/26* (2013.01);
(Continued)

(58) Field of Classification Search
CPC H01H 1/26; H01H 1/62; H01H 50/10; H01H 1/5822; H01H 50/642;
(Continued)

(56) References Cited

U.S. PATENT DOCUMENTS 3,586,809 A 6/1971 Santi
3,829,647 A 8/1974 Cleaveland
(Continued)

FOREIGN PATENT DOCUMENTS

DE 002726730 1/1979
DE 003721286 1/1989
(Continued)

OTHER PUBLICATIONS

International Search Report corresponding to International Application No. PCT/GB2014/050689 mailed Oct. 6, 2014.
(Continued)

*Primary Examiner* — Edwin A. Leon
(74) *Attorney, Agent, or Firm* — Myers Bigel, P.A.

(57) ABSTRACT

The present invention is related to a switching device having a contactor and an actuator. The contactor has at least a first contactor member and a second contactor member. The actuator is configured to actuate the contactor. At least one of the contactor members has a varying or variable thickness along its length such that the at least one of the contactor members has a relatively thick portion and a relatively thin portion.

19 Claims, 5 Drawing Sheets

(51) Int. Cl.

| | |
|---|---|
| *H01H 1/26* | (2006.01) |
| *H01H 1/62* | (2006.01) |
| *H01H 50/10* | (2006.01) |
| *H01H 50/14* | (2006.01) |
| *H01H 51/22* | (2006.01) |

(52) U.S. Cl.
CPC ..... *H01H 1/62* (2013.01); *H01H 50/10* (2013.01); *H01H 50/14* (2013.01); *H01H 51/2272* (2013.01)

(58) Field of Classification Search
CPC ..... H01H 51/2272; H01H 50/14; H01H 1/54; H01H 50/641; H01H 50/54; H01H 1/021; H01H 50/648; H01H 2205/002; H02B 1/42; H01R 33/00; H01R 13/18; H01R 13/64
USPC ... 200/284, 263, 266, 275, 283, 289, 19, 61, 200/506; 439/251, 263, 268; 218/117; 335/201; 29/876
See application file for complete search history.

(56) References Cited

U.S. PATENT DOCUMENTS

| | | | | |
|---|---|---|---|---|
| 4,539,545 | A | 9/1985 | Klotz | |
| 5,160,910 | A * | 11/1992 | Tsuji ..... | H01H 50/642 335/121 |
| 5,712,611 | A | 1/1998 | Mattes et al. | |
| 6,121,560 | A | 9/2000 | Turkmen | |
| 6,246,306 | B1 | 6/2001 | Gruner | |
| 6,252,478 | B1 | 6/2001 | Gruner | |
| 6,619,967 | B2 * | 9/2003 | Murakoshi ..... | H01R 9/2425 439/76.2 |
| 7,659,800 | B2 * | 2/2010 | Gruner ..... | H01H 1/26 335/185 |
| 2010/0059479 | A1 | 3/2010 | Kurth et al. | |
| 2011/0048907 | A1 | 3/2011 | Moeller et al. | |

FOREIGN PATENT DOCUMENTS

| | | |
|---|---|---|
| EP | 0343274 | 11/1989 |
| EP | 2385536 | 11/2011 |
| EP | 2477203 | 7/2012 |
| EP | 2 551 870 A1 | 1/2013 |
| EP | 2551870 | 1/2013 |
| GB | 1202251 | 8/1970 |
| GB | 1206980 | 9/1970 |
| GB | 1471568 | 4/1977 |
| GB | 2140212 | 11/1984 |
| GB | 2 353 409 A | 2/2001 |
| GB | 2353409 | 2/2001 |
| JP | S59214125 | 12/1984 |
| JP | 2003272501 | 9/2003 |
| JP | 050020950 | 1/2005 |
| JP | 2006100026 | 4/2006 |
| WO | WO 2009/144150 | 12/2009 |

OTHER PUBLICATIONS

Written Opinion corresponding to International Application No. PCT/GB2014/050689 mailed Oct. 6, 2014.
Office Action for Chinese Patent Application No. 2014800313103.X mailed Nov. 23, 2016 with translation, 39 pages.
Office Action for EP application No. 14710360.0 mailed Jan. 3, 2017, 6 pages.

* cited by examiner

SWITCH AND ASSOCIATED METHODS

RELATED APPLICATIONS

This application is a 35 U.S.C. §371 national stage application of PCT Application No. PCT/GB2014/050689, filed on Mar. 7, 2014, which claims priority from British Application No. 13042243, filed on Mar. 8, 2013, the contents of each of which are incorporated herein by reference in their entireties. The above-referenced PCT International Application was published as International Publication No. WO 2014/135898 A1 on Sep. 12, 2014.

FIELD

The present invention relates to an improved switching device and associated methods; in particular, but not exclusively, to an improved disconnect relay, such as for domestic or industrial electricity switching.

BACKGROUND

Switching devices, such as for smart metering or for control of domestic, residential or vehicle power, often comprise a contactor and an actuator, such as a solenoid coil. The switching devices may be for safely connecting or disconnecting power, such as mains electricity. For example, meters or smart meters may be used to control power supply, such as depending on payment or demand.

The switching devices may be subjected to particular currents, such as high short circuit currents. Typically, the contactor will have a moving blade to effect connection or disconnection. A contact on the moving blade will selectively engage a contact on a fixed bus-bar. Electromagnetic repulsion between the moving blade and the bus-bar, such as due to Lorenz forces, may force the moving blade away from the bus-bar. Under high currents, such as due to short circuits, the contacts may be forced apart, resulting in sparking, local heating, damage to the switch or other potential hazards.

The actuator can be activated, such as by pulsing the solenoid coil, to provide a force sufficient to overcome an attractive force between the contacts, such that the contacts can be intentionally separated when desired to effect disconnection. In some embodiments the actuator provides a component of contact pressure to maintain connection between the contacts in particular circumstances. If the switching device does not provide sufficient contact pressure in particular circumstances, the contacts may separate or provide a poor connection. In some circumstances, a particular contact pressure, particularly a constant contact pressure, may allow the contacts to be effectively welded together by current passing therethrough.

The subject matter of the present disclosure is directed to overcoming, or at least reducing the effects of, one or more of the problems set forth above.

SUMMARY

According to an aspect of the invention there is provided a switching device.

The switching device may comprise an actuator.

The switching device may comprise a contactor.

The actuator may be configured to actuate the contactor.

The contactor may comprise at least a first contactor member and a second contactor member.

At least one of the contactor members may comprise a varying or variable thickness. For example, the thickness of the contactor member may vary along its length.

At least one of the contactor members may comprise a relatively thick and a relatively thin portion. The relatively thin portion may comprise a dynamic or a flexible portion, such as a moving blade. The relatively thick portion may comprise a bus-bar or a blade-carrier. The contactor member may comprise a cantilever arm.

The contactor member may comprise a first portion and a second portion. The first portion may comprise the relatively thin portion. The second portion may comprise the relatively thick portion.

The/each contactor member may be unitary. The/each contactor member may be integrally-formed.

The relatively thick and thin portions may be integral.

The/each contactor member may be a single unitary piece.

The relatively thick and thin portions may be integrally-formed.

The relatively thick and thin portions may be substantially continuous.

The switching device may comprise a remote disconnect switching device, such as a remotely-operable or remotely-operated disconnect switching device. The switching device may comprise a disconnect relay, such as for a smart meter. The switching device may comprise a load switch. The switching device may comprise a supply control switch. The switching device may comprise an auxiliary control switch.

The switching device may comprise a single pole switch.

The switching device may comprise a switching device for connecting and/or disconnecting a power load from a voltage source, such as from mains electricity. The switching device may comprise a high current switching device.

The switching device may comprise a current rating and/or be configured to bear a nominal load in the range of about 10 to 400 Amps; or about 60 Amps to about 200 Amps; or about 20 Amps to about 120 Amps; or about 50 Amps to about 150 Amps; or about 80 Amps to about 120 Amps. The switching device may be suitable for currents in excess of about 200 Amps. The rating may correspond to a nominal load.

The switching device may be rated and/or suitable for kiloampere loads; such as for 6000 Amps or more. The switching device may be configured to withstand a short circuit load, such as thirty times the nominal load.

The switching device may comprise a domestic or residential electricity switching device. The switching device may comprise an industrial electricity switching device. The switching device may comprise an AC switching device. The switching device may comprise a DC switching device, such as for low voltage sources (e.g. for vehicle batteries).

The switching device may comprise a cyclical switching device. For example, the switching device may be rated and/or suitable for at least 5000; at least 10000; at least 15000 operating cycles respectively, such as electrically operating cycles.

The relatively thin portion may comprise a thickness, such as a nominal thickness, less than or equal to about half of the thickness, such as a nominal thickness, of the relatively thick portion. The relatively thin portion may comprise a thickness less than or equal to about 40% of the thickness of the relatively thick portion. The relatively thin portion may comprise a thickness less than or equal to about 30% of the thickness of the relatively thick portion. The relatively thin portion may comprise a thickness less than or equal to about 20% of the thickness of the relatively thick portion. The relatively thin portion may comprise a thickness less than or equal to about 10% of the thickness of the relatively thick portion. The relatively thin portion may comprise a thickness less than or equal to about 5% of the thickness of the relatively thick portion.

The contactor member may comprise a transition portion between the relatively thick portion and the relatively thin portion.

The transition portion may be configured to provide a smooth transfer between the relatively thick portion and the relatively thin portion. The transition portion may be configured to provide a smooth transfer of electrical load between the relatively thick portion and the relatively thin portion. The transition portion may be configured to provide a smooth transfer of mechanical load between the relatively thick portion and the relatively thin portion. The transition portion may be configured to provide a smooth transfer of thermal load between the relatively thick portion and the relatively thin portion.

The transition portion and/or the relatively thick portion and/or the relatively thin portion may be substantially homogenous. For example, the transition portion and/or the relatively thick portion and/or the relatively thin portion may comprise similar or identical properties. The similar or identical properties may comprise a type of material and/or a mechanical property and/or an electrical property and/or a thermal property.

Additionally or alternatively, the transition portion and/or the relatively thick portion and/or the relatively thin portion may be substantially dissimilar in at least one property. For example, the transition portion and/or the relatively thick portion and/or the relatively thin portion may comprise dissimilar properties from at least one of the other portions. The dissimilar property/ies may comprise a type of material and/or a mechanical property and/or an electrical property and/or a thermal property.

The contactor member may comprise a bimetallic contactor member. For example, the relatively thick portion may comprise a first metal and the relatively thin portion may comprise a second metal.

The transition portion and/or the relatively thick portion and/or the relatively thin portion may comprise copper. The transition portion and/or the relatively thick portion and/or the relatively thin portion may comprise a copper alloy. The relatively thick portion may comprise a first copper material and the relatively thin portion may comprise a second copper material. The first copper material may be configured for optimal heat dissipation and/or electrical conductivity. The second copper material may be configured to provide good spring properties, such as improved elasticity and/or durability under loading (e.g. cyclic or dynamic flexure). The first copper material may substantially comprise copper. The second copper material may comprise a copper alloy, such as a copper/zirconium alloy or the like.

The relatively thick portion and the relatively thin portion may be axially aligned at the transition portion such that the relatively thin portion is an axial extension of the relatively thick portion.

The transition portion may comprise a chamfer, a radius, a rib, or the like. The transition portion may be configured to prevent peeling of the relatively thin portion from the relatively thick portion. The contactor member may be configured to substantially tensionally and/or compressively load the transition portion.

The transition portion may be formed by fusion. The transition portion may be formed by electron beam welding, such as continuous electron beam welding. The transition portion may comprise a fused portion.

The relatively thick and the relatively thin portions may be joined by electron beam welding.

The contactor member may comprise a bimetallic strip. The relatively thin and/or the relatively thick portion/s may comprise the bimetallic strip. The relatively thin portion may overlap the relatively thick portion, such as to form a lap connection.

The transition portion may comprise a lap connection, such as a lap fusion.

The transition portion may comprise a butt connection, such as a butt fusion.

The contactor member configured to dissipate heat at an increased rate.

The contactor member may comprise an increased surface area. The contactor member may comprise a surface area of at least one side or face that is substantially greater than the footprint and/or planar projection of said side or face.

The surface area of the at least one side or face may be substantially discontinuous. The surface area of the at least one side may be configured to dissipate substantially more heat than an equivalent continuous or planar surface. The contactor member may comprise a non-uniform and/or non-homogenous and/or asymmetrical and/or anisotropic cross-section at at least one portion.

The contactor member may comprise one or more protrusions and/or one or more recesses; such as in the at least one side or face. The contactor member may comprise a plurality of protrusions and/or recesses.

The recess/es may comprise an indentation; and/or a dimple and/or a depression and/or a slot and/or a hole or aperture. The recess may comprise a blind recess. The recess may comprise a through-hole.

The recess may comprise a continuous recess. For example, the recess may comprise a continuous slot, such as a serpentine or a labyrinthine slot.

The contactor member may be substantially planar.

The protrusion/s may comprise a convex surface/s.

The contactor member may be convex.

The protrusion/s may comprise a concave surface/s.

The contactor member may be concave.

The contactor member may be curved.

The contactor member may comprise a variable thickness. A cross-section of the contactor member, such as parallel and/or perpendicular to a longitudinal axis of the contactor member, may comprise a variable thickness.

The contactor member may comprise a uniform thickness. For example, a recess in a first side or face of the contactor member may correspond to a protrusion in a corresponding (e.g. opposite) second side or face of the contactor member; and/or vice versa.

The recess/es and/or protrusion/s may be longitudinally and/or laterally arranged, such as along and/or perpendicular to a longitudinal axis of the contactor member.

The contactor member may comprise a hinge.

The hinge may comprise a U-bend or a U-shaped bend.

The contactor member may comprise a U-shape or a U-bend.

The hinge may comprise a defined radius, such as a bending radius. The radius may provide for a predetermined separation of portions of the contactor member either side of the hinge, such as adjacent the hinge. The radius may provide for a minimum separation. The radius may provide for a maximum separation.

The hinge may define a pivot axis. The hinge may define a virtual pivot axis.

The hinge may comprise a portion of reduced stiffness. The hinge may be configured to reduce a required opening force.

The hinge may comprise a portion of increased flexibility. The hinge may comprise a portion of reduced cross-sectional area relative to the thick and/or thin portion/s of the contactor member. Alternatively, the hinge may comprise a portion of substantially similar cross-sectional area relative to the thick and/or thin portion/s of the contactor member.

Increased flexibility may allow the moving blade to deflect easily, such as to allow the contact/s mounted to the moving blade to oscillate or rock in use (e.g. to prevent welding of the contacts or pairs of contacts).

The portion of increased flexibility may comprise a reduced width, such as a necking or a waisting. The portion of increased flexibility may comprise a reduced thickness. The portion of increased flexibility may comprise a recess and/or an aperture or the like. The portion of increased flexibility may comprise a different material property relative to the thick and/or thin portion/s of the contactor member. For example, the portion of increased flexibility may comprise a material of reduced Young's modulus relative to the material of the thick and/or thin portion/s of the contactor member.

The contactor member may comprise a plurality of hinges. For example, the contactor member may comprise at least a first hinge, such as in the form of a U-bend, and at least a second hinge, such as in the form of a portion of reduced stiffness. The first and second hinges may be located proximal or adjacent to each other. The first and second hinges may be coincidentally located. The first and second hinges may be located distal to each other. The portion of reduced stiffness may be located at the U-bend. The portion of reduced stiffness may be located adjacent the U-bend.

The hinge may be located distal to the transition portion.

The hinge may be located proximal to the transition portion.

The hinge may be located at the transition portion.

The hinge may be located in the relatively thin portion.

The hinge may be located in the relatively thick portion.

The hinge may be located between the relatively thick portion and the contact.

The hinge may provide for a similar deflection at a reduce force. The hinge may provide for an increased deflection at a similar force. The hinge may allow for a reduced length of contactor member.

The hinge may be located distal to a contact/s of the contactor member. The moving blade may comprise a contact or a plurality of contacts. A second contactor member may comprise a corresponding contact/s.

The second contactor member may comprise a static contactor member. The second contactor member may comprise a fixed bus-bar.

The second contactor member may be substantially similar to the first contactor member; such as comprising a bus-bar and a moving blade.

At least a part of the relatively thick portion and at least a part of the relatively thin portion may be arranged substantially parallel to each other in the ON and/or OFF configuration/s.

At least a part of the relatively thick portion and at least a part of the relatively thin portion may be angularly offset. For example, the moving blade portion carrying the contact may be angularly offset such that the moving blade and the bus-bar diverge away from the hinge in the ON and/or OFF configuration/s. The angular offset may comprise a convergent angle in the ON and/or OFF configuration/s. The angular offset may comprise a divergent angle in the ON and/or OFF configuration/s.

The contactor member/s may comprise a bifurcation/s.

The device may comprise a housing. The housing may be insulating.

The contactor member may extend through the housing, such as through an opening or aperture from within the housing to external to the housing. The relatively thick portion may extend through the housing, such as through the opening or aperture from within the housing to external to the housing. The contactor member may be configured for electrical connection external to the housing.

The contactor member may comprise an internal portion within the housing and an external portion outside the housing. The relatively thick portion may comprise the internal and/or the external portion/s. The internal and/or the external portion/s may be configured to dissipate heat at an increased rate. The internal and/or the external portion/s may comprise an increased surface area. The internal and/or the external portion/s contactor member may comprise the side/s or face/s with the surface area/s that is/are substantially greater than the footprint and/or planar projection of said (respective) sides or face/s.

The side/s or face/s with the greater surface area/s may be located in the internal and/or external portion/s. The side/s or face/s with the greater surface area/s may comprise the one or more protrusions and/or one or more recesses; such as in the side/s or face/s.

The actuator may comprise an electromagnetic coil.

The actuator may comprise a solenoid.

The actuator may comprise a coil winding.

The actuator may comprise a coil field member.

The actuator may comprise a magnet. The actuator may comprise a permanent magnet. The actuator may comprise a magnet latching actuator.

The actuator may comprise a unitary actuator. The actuator may comprise a single-piece actuator.

The actuator may be configured to actuate the contactor in response to a magnetic field generated by the coil winding and the coil field member.

The device may be configured to balance forces. The device may comprise an aligned force transmission system.

The transmission system may be configured to improve the effectiveness of generated forces. The transmission system may be configured to minimise system losses. The transmission system may be configured to minimise unwanted mechanical distortion of any components or structures and/or any undesired stresses in components or structures.

The device may be configured to balance forces transmitted between the actuator and the contactor.

The device may be configured to align contact points of force transmission.

The device may be configured to prevent or at least reduce torsional forces. The device may be configured to prevent or at least reduce twisting.

The actuator and the contactor may be arranged such that force is transmitted between components of the actuator and the contactor substantially in a plane. The plane may be substantially perpendicular to a contactor member, such as the moving blade. The movement of the moving blade may be substantially in plane with the force transmission system. The plane may comprise a central plane. The plane may pass through a centroid of the contactor and/or the actuator. For example, the plane may pass through a center or central axis of a contactor member. The plane may pass through a centroid of the actuator and/or the contactor. The device may be configured to prevent out of plane forces. The device may be configured to substantially transmit all forces in plane. The device may be configured to prevent pivoting, twisting or torsion of components, such as out of the plane. The forces may act along a central plane of the device. The forces may act along a centreline of the device.

The actuator may comprise an actuator arrangement to act upon a contactor member. The actuator arrangement may be configured to act upon or transmit force to the contactor member at a central portion of the contactor member. The actuator arrangement may be configured act along the plane aligned with a central axis of the contactor member.

The device may be configured to allow the actuator to act directly on a central portion of the contactor member. The device may be configured to allow the actuator arrangement to act directly on a moving blade. The contactor member may comprise an aperture or recess or slot to allow the actuator arrangement to pass through. The aperture or recess may be centrally located in the contactor member. The aperture or recess may allow the actuator arrangement to pass through centrally. The aperture or recess may allow the aperture arrangement to transmit force to the contactor member substantially linearly. The aperture or recess may allow the actuator member to transmit force internally centrally. The aperture or recess may allow the actuator member to transmit force directly to the moving blade. The aperture arrangement may allow the actuator arrangement or the actuator member to be substantially purely compressively and/or tensionally loaded. The device may be configured to substantially centrally load the force transmission system.

The actuator arrangement may transmit force to the moving blade distal to the hinge, such as distal to the U-bend. The actuator arrangement may be configured to transmit force to the moving blade at a maximum separation from the hinge, such as from the U-bend. The actuator arrangement may be configured to transmit force to the moving blade proximal to one or more contacts.

The actuator arrangement may be configured to force the moving blade towards the ON configuration (e.g. to push). The actuator arrangement may be configured to provide a force to the moving blade in the ON configuration to maintain engagement of the contact/s between the first and second contactor members. The actuator arrangement may be configured to force the moving blade towards the OFF configurations (e.g. to pull).

The actuator arrangement may comprise a pivotable actuator member. The pivotable actuator member may comprise a rotary actuating member. The pivotable actuating member may be configured to pivot about an axis in response to a magnetic field generated by the coil winding and the coil field member. The actuator may comprise a pivotable actuator pivot. The pivot may be arranged to allow the pivotable actuator member to pivot about an axis perpendicular to the central plane. The pivotable actuator member may comprise a rotary motor.

A center of the pivotable actuator member may be located in the central plane. The centroid of the pivotable actuator member may be located in the central plane.

The actuator arrangement may comprise a lever.

The actuator arrangement may comprise a substantially linear actuator member configured to translate substantially linearly.

The actuator arrangement may be configured to disconnect and/or connect at least one pair of contacts provided in the contactor.

The linear actuator member may act directly on the contactor. For example, the linear actuator member may engage the moving blade.

The pivotable actuator member may act directly on the contactor. For example, the pivotable actuator member may engage the moving blade.

The pivotable actuator member may be configured to cooperate with the linear actuator member. The pivotable actuator member may be configured to cooperate with the linear actuator member to convert a substantially rotational force, such as generated by the coil, into a substantially linear force.

The actuator may comprise a coupling arrangement between the pivotable actuator member and the linear actuator member. The coupling arrangement may comprise an interengaging coupling arrangement.

One of the pivotable or linear actuator members may comprise a recess and the other of the pivotable or linear actuator members may comprise a corresponding protrusion. The protrusion may comprise an arm or lever.

The coupling arrangement may be configured to eliminate or at least reduce play between the actuator members. The coupling arrangement may comprise a snug fit. The coupling arrangement may comprise an interference fit. The coupling arrangement may comprise a press fit. The coupling arrangement may comprise a snap fit.

The coupling arrangement may be configured to ensure engagement between the actuator members. The coupling arrangement may be configured to provide full engagement between the pivotable actuator member and the linear actuator member at all times, such as throughout all movements and/or reconfigurations. The coupling arrangement may be configured to provide engagement between the pivotable actuator member and the linear actuator at the same contact points or surfaces at all times. For example the coupling arrangement may comprise a first interface for transferring load between the pivotbale and linear actuator members in a first direction of movement, such as a first linear direction of movement; and a second interface for transferring load between the pivotable and linear actuator members in a second direction of movement, such as opposite to the first direction of movement. The coupling arrangement may ensure engagement at the first and second interfaces at all times. Each interface may comprise contact points or surfaces of the actuator members. Engagement may comprise contact, such as load-bearing contact.

The coupling arrangement may be configured to maximise linear travel of the linear actuator member in response to a predetermined displacement of the pivotable actuator member.

The coupling arrangement may be configured to provide a maximum contact surface area between the linear and the pivotable actuation members at or around the initiation of an actuation, such as a connect and/or a disconnect. Providing a maximum contact surface area may reduce pressure for a given force, such as a maximum force and/or a static force.

The coupling arrangement may be configured to provide a minimum contact surface area between the linear and the pivotable actuation members at or around the completion of an actuation, such as a connect and/or a disconnect.

The coupling arrangement may be configured to provide a maximum contact surface area between the linear and the pivotable actuation members in a direction of movement at or around the initiation of an actuation, such as a connect and/or a disconnect.

The coupling arrangement may be configured to provide a minimum contact surface area between the linear and the pivotable actuation members in the direction of movement at or around the completion of an actuation, such as a connect and/or a disconnect.

The coupling arrangement may be configured to provide a minimum contact surface area between the linear and the pivotable actuation members opposite the direction of movement at or around the initiation of an actuation, such as a connect and/or a disconnect.

The coupling arrangement may be configured to provide a maximum contact surface area between the linear and the pivotable actuation members opposite the direction of movement at or around the completion of an actuation, such as a connect and/or a disconnect. Providing a maximum contact surface area opposite the direction of movement towards the completion of an actuation may provide for a reliable and/or consistent and/or accurate positioning of the actuation members upon completion of the actuation.

The coupling arrangement may be configured to vary the location or position of the maximum and/or minimum contact surface area/s between the linear and the pivotable actuation members according to the direction of travel. For example, the coupling arrangement may comprise the first interface for transferring load from the pivotable actuator member to the linear actuator member in the first direction of movement. The second interface may be for transferring load from the pivotable actuator member to the linear actuator member in the second direction of movement. The first interface may be opposite the second interface. For example, the first interface may be located on a first side of the pivotable actuator member (e.g. the first side being in the direction of movement in a first stage or portion of actuation); and the second interface may be located on a second side of the pivotable actuator member (e.g. the second side being in the direction of movement in a second stage or portion of actuation or of a different actuation or deactuation).

The first direction of movement may be in a direction of a connect actuation. The second direction of movement may be in a direction of a disconnect actuation, or a deactuation.

The coupling arrangement may comprise an angular element corresponding to an angle of rotation of the pivotable member between configurations, such as between the ON and OFF configurations.

The protrusion may comprise an angular portion, such as a wedge. The angular portion may comprise an angle corresponding to an angle of rotation of the pivotable member between configurations, such as between the On and OFF configurations.

The recess and protrusion may each comprise a pair of corresponding engagement surfaces. The coupling arrangement may be configured to substantially maintain contact between the corresponding engagement surfaces, such as throughout actuation and/or during periods of ON and/or OFF configurations.

The protrusion may be substantially parallel to the contactor member, such as to the moving blade. The protrusion may be substantially parallel to the contactor member in the ON and/or OFF configurations. The protrusion may be substantially parallel to the contactor member in a neutral configuration, such as midway between the ON and OFF configurations.

The pivotable and linear members may be unitary, such as integrally formed.

The actuator may comprise a resilient member. The resilient member may be configured to apply a compressive force to the actuator member/s. The resilient member may be configured to apply a tensile force to the actuator member/s. The resilient member may be configured to apply a pretension to the actuator member/s.

The resilient member may be configured to bias the actuator towards a particular state or configuration. The particular state or configuration may comprise the OFF configuration. Alternatively, the particular configuration may comprise the ON configuration.

The resilient member may comprise a spring. The resilient member may comprise a compression spring. The resilient member may comprise a tensile spring. The resilient member may comprise a coil spring. The resilient member may comprise a leaf spring. The resilient member may comprise a Belleville spring. The resilient member may comprise an elastic material. The actuator may comprise a plurality of resilient members.

The transmission system may comprise the coil and/or the pivotable actuator member and/or the linear actuator member and/or the resilient member/s and/or the coupling arrangement and/or the contact or pair/s of contacts and/or the contactor member/s.

The device may be configured to minimise a net force between contacts in response to current flowing (e.g. Lorenz force). The device may be configured to generate a similar repulsive force between the moving blade and a first bus-bar and between the moving blade and a second bus-bar. The moving blade may be substantially equidistant the first and second bus-bars. The moving blade may be substantially equidistant the first and second bus-bars in at least the ON configuration.

According to a further aspect of the invention there is provided a contactor member for a switching device; such as a switching device according to the first aspect.

The contactor member may comprise a relatively thick portion and a relatively thin portion The relatively thick portion and the relatively thin portion may be substantially integral or unitary.

The relatively thick portion may comprise a substantially rigid portion. The relatively thin portion may comprise a flexible portion. The relatively thick portion may comprise a bus-bar. The relatively thin portion may comprise a moving blade.

The relatively thick portion and the relatively thin portion may share at least one substantially continuous common surface or face. The relatively thick portion and the relatively thin portion may share a plurality of substantially continuous common surfaces or faces.

The relatively thick portion and the relatively thin portion may be substantially integrally formed.

According to a further aspect of the invention there is provided a method of connecting a relatively thin portion/first portion of a contactor member of a switching device to a relatively thick portion/second portion of the contactor member of a switching device.

The method may comprise connecting the first or relatively thin portion of the contactor member of the switching device to the second or relatively thick portion of the contactor member of the switching device so as to form a substantially continuous or integral contactor member of variable thickness.

The method may comprise eliminating losses in electrical resistance caused by mechanical joints.

The method may comprise forming at least one substantially continuous surface or face extending from the relatively second/thick portion to the first/relatively thin portion.

The method may comprise fusing the first/relatively thin portion to the second/relatively thick portion.

The method may comprise continuous electron beam welding the first/relatively thin portion to the second/relatively thick portion.

The method may comprise electron beam welding the first/relatively thin portion to the second/relatively thick portion.

The first/relatively thin portion may comprise a dynamic or flexible portion, such as a moving blade. The second/relatively thick portion may comprise a substantially rigid or static portion. The second/relatively thick portion may comprise a bus-bar or blade carrier.

The method may comprise providing a transition portion between the second/relatively thick and first/relatively thin portions.

The method may comprise forming the transition portion with electron beam welding.

The method may comprise making the transition portion substantially continuous.

The method may comprise providing the transition portion and/or the second/relatively thick and/or first/relatively thin portion/s with substantially homogenous properties. The properties may comprise electrical and/or mechanical and/or thermal properties. The method may comprise providing substantially continuous properties across the transition portion, such as relative to an alternative connecting method, such as mechanically connecting (e.g. riveting) and/or welding the second/relatively thick and first/thin portions together.

The method may comprise connecting portions of similar properties. For example, the relatively thin portion/first portion and the relatively thick portion/second portion may comprise similar materials, such as both of copper or both of a copper alloy.

Additionally or alternatively, the method may comprise connecting portions of dissimilar properties. For example, the relatively thin portion/first portion and the relatively thick portion/second portion may comprise materials of dissimilar properties, such as a first copper material and a second copper material. For example the first copper material may substantially comprise copper and the second copper material may comprise a copper alloy. The copper alloy may comprise a high copper alloy, such as cadmium/copper, beryllium/copper, chromium/copper, zirconium/copper, and/or combinations thereof such as chromium-zirconium copper.

Connecting portions of similar and/or dissimilar properties may comprise joining by electron beam welding.

According to a further aspect of the invention, there is provided a bus-bar for a switching device, the bus-bar configured to dissipate heat (at an increased rate).

The bus-bar may comprise an increased surface area. The bus-bar may comprise a surface area of at least one side or face that is substantially greater than the footprint and/or planar projection of said side or face.

The surface area of the at least one side or face may be substantially discontinuous. The surface area of the at least one side may be configured to dissipate substantially more heat than an equivalent continuous or planar surface. The bus-bar may comprise a non-uniform and/or non-homogenous and/or asymmetrical and/or anisotropic cross-section at at least one portion.

The bus-bar may comprise one or more protrusions and/or one or more recesses; such as in the at least one side or face. The bus-bar may comprise a plurality of protrusions and/or recesses.

The recess/es may comprise an indentation; and/or a dimple and/or a depression and/or a slot and/or a hole or aperture. The recess may comprise a blind recess. The recess may comprise a through-hole.

The recess may comprise a continuous recess. For example, the recess may comprise a continuous slot, such as a serpentine or a labyrinthine slot.

The bus-bar may be substantially planar.

The protrusion/s may comprise a convex surface/s.

The bus-bar may be convex.

The protrusion/s may comprise a concave surface/s.

The bus-bar may be concave.

The bus-bar may be curved.

The bus-bar may comprise a variable thickness. A cross-section of the bus-bar, such as parallel and/or perpendicular to a longitudinal axis of the bus-bar, may comprise a variable thickness.

The bus-bar may comprise a uniform thickness. For example, a recess in a first side or face of the bus-bar may correspond to a protrusion in a corresponding (e.g. opposite) second side or face of the bus-bar; and/or vice versa.

The recess/es and/or protrusion/s may be longitudinally and/or laterally arranged, such as along and/or perpendicular to a longitudinal axis of the bus-bar.

According to a further aspect of the invention, there is provided a switching device configured to balance forces. The device may comprise an aligned force transmission system.

The device may be configured to balance forces transmitted between an actuator and a contactor.

The device may be configured to align contact points of force transmission.

The device may be configured to prevent or at least reduce torsional forces. The device may be configured to prevent or at least reduce twisting.

According to a further aspect of the invention there is provided a method of transmitting forces between an actuator and a contactor of a switching device.

The method may comprise transmitting the forces through an aligned force transmission system.

The method may comprise transmitting the forces substantially along a central plane.

The method may comprise arranging components of a force transmission system in a plane. The method may comprise arranging the components of a force transmission system such as to reduce or eliminate torsion. The method may comprise substantially eliminating force losses, such as due to undesired force components (e.g. undesired tangential and/or torsional force components or vectors).

According to a further aspect of the invention there is provided a switching device configured to prevent or reduce unintended activation.

The device may comprise a coil shield. The coil shield may be directional. The coil shield may be configured to improve the magnetic field in the direction of the permanent magnet. The coil shield may be configured to reduce the risk that the switch can be otherwise activated, such us unauthorised or unintentional activation. For example, the coil shield may prevent or at least mitigate tampering, such as from a rare-earth magnet held against the side of the device.

The invention includes one or more corresponding aspects, embodiments or features in isolation or in various combinations whether or not specifically stated (including claimed) in that combination or in isolation. For example, it will readily be appreciated that features recited as optional with respect to the first aspect may be additionally applicable with respect to the other aspects without the need to explicitly and unnecessarily list those various combinations and permutations here (e.g. the contactor member of one aspect may comprise features of any other aspect). Optional features as recited in respect of a method may be additionally applicable to an apparatus; and vice versa.

In addition, corresponding means for performing one or more of the discussed functions are also within the present disclosure.

It will be appreciated that one or more embodiments/aspects may be useful in connecting and/or disconnecting electricity, such as bus-bars.

The above summary is intended to be merely exemplary and non-limiting.

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Figure 1:
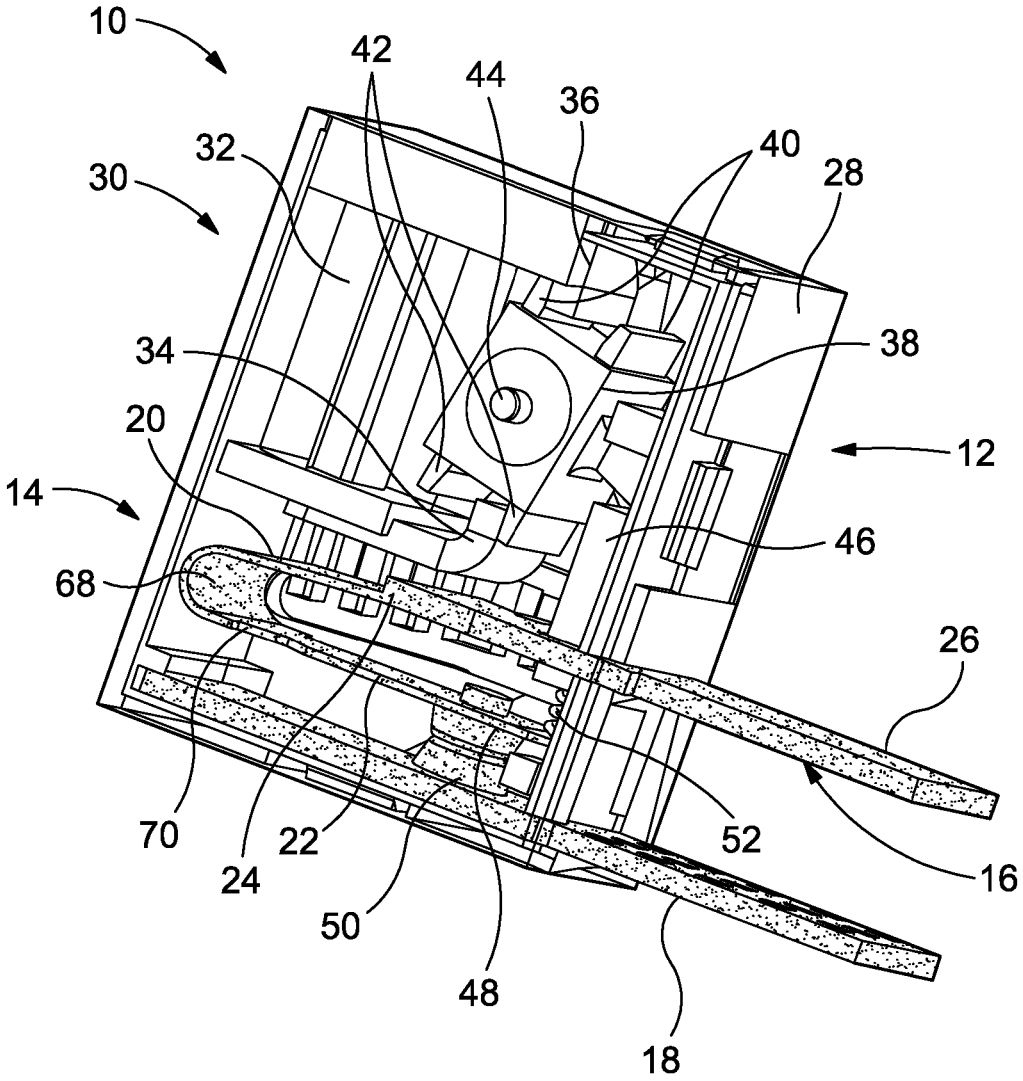
FIG. 1 shows a switching device in accordance with a first embodiment of the invention in an ON configuration.

Reference is first made to FIG. 1 of the drawings, which illustrates a switching device 10, in accordance with an embodiment of the present invention.

The switching device 10 comprises an actuator 12 and a contactor 14. The actuator 12 is configured to actuate the contactor 14. The contactor 14 comprises a first contactor member 16 and a second contactor member 18.

The first contactor member 16 comprise a variable thickness, with a relatively thin portion 20 with a moving blade 22, and a relatively thick portion in the form of a planar bus-bar or a blade-carrier 26. The relatively thick and thin portions 20, 26 are integral, the first contactor member 16 being a single unitary piece.

The relatively thick and thin portions 20, 26 are substantially continuous. The relatively thick and thin portions 20, 26 are joined by electron beam welding to form the first contactor member 16.

In the embodiment shown, the switching device 10 is a 60 Amp single pole switching device. However, in other embodiments, similar or like components may be used. For example, the same actuator 12, or at least components thereof, may be used in, for example, a 100 Amp device, or in a 200 Amp two pole device. Features or components may be modified, such as scaled appropriately, to provide embodiments for other ratings, such as 100 Amps. The switching device 10 shown is suitable for low short circuit or high short circuit conditions. The rating may correspond to a nominal load.

The device 10 comprises an insulating housing 28. The actuator 12 comprises an electromagnetic coil 30 with a coil winding 32 and a pair of coil field pieces 34, 36. Here, both the first contactor member 16 and the second contactor member 18 extend through an opening or aperture from within the housing 28 to external to the housing 28. The relatively thick portion 26 extends through one of the openings or apertures from within the housing 28 to external to the housing 28. The first and second contactor members 16, 18 are configured for electrical connection external to the housing 28.

Here, the actuator 12 is a permanent magnet latching actuator. The actuator 12 is configured to actuate the contactor 14 in response to a magnetic field generated by the coil winding 32 and the coil field pieces 34, 36.

The actuator 12 comprises an actuator arrangement with a pivotable actuator member 38 in the form of a rotary actuator member. The pivotable actuator member 38 comprises an overmoulded permanent magnet, with respective pairs of field members 40, 42 for cooperation with the respective coil field pieces 34, 36. The pivotable actuating member is configured to pivot about an axis or pivot 44 in response to a magnetic field generated by the coil winding 32 and the coil field pieces 34, 36. The pivot 44 is arranged to allow the pivotable actuator member 38 to pivot about an axis perpendicular to a central plane of the device 10.

The actuator arrangement comprises a substantially linear actuator member 46 configured to translate substantially linearly. In the embodiment shown, the linear actuator member 46 is guided in the housing 28 to translate substantially perpendicular to the moving blade 22. The actuator arrangement is configured to disconnect and connect a pair of contacts 48, 50 provided in the contactor 14. In the embodiment shown, the contacts 48, 50 are silver-coated or plated. In use, the linear actuator member 46 acts directly on the contactor 14 by engaging the moving blade 22.

In the embodiment shown, the pivotable and linear actuator members 38, 46 are discrete. In other embodiments, the pivotable and linear members may be unitary, such as integrally formed.

The actuator 12 comprises a resilient member 52. The resilient member 52 is configured to apply a compressive force to the linear actuator member 46. The resilient member 52 is configured to bias the actuator towards a particular state or configuration, which is the OFF configuration in the embodiment shown (noting that the OFF configuration is not depicted).

Here, the resilient member 52 comprises a compression coil spring. In other embodiments alternative or additional resilient members or types of resilient members may be provided.

Figure 2:
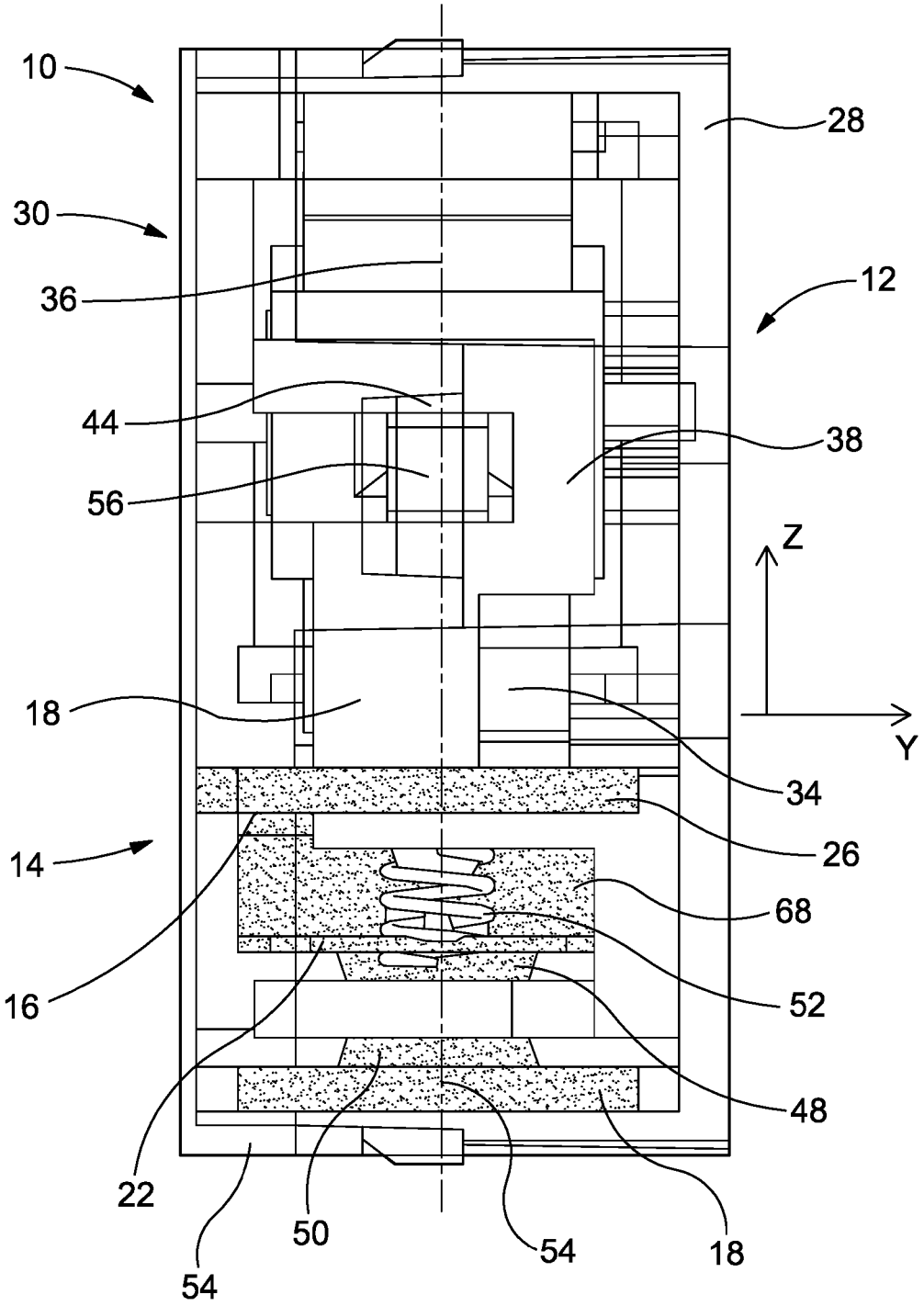
FIG. 2 shows a cross sectional view of the switching device of FIG. 1.

In use, the device 10 is configured to balance forces. As illustrated in FIG. 2, showing a cross-section of the device 10, the device 10 comprises an aligned force transmission system. The device 10 is configured to balance forces transmitted between the actuator 12 and the contactor 14. The device 10 is configured to align contact points of force transmission. The transmission system comprises the coil 30 and the pivotable actuator member 38 and the linear actuator member 46 and the resilient member 52 and the pair of contacts 48, 50 and the contactor members 16, 18.

The device 10 is configured to prevent or at least reduce torsional forces. The device 10 is configured to prevent or at least reduce twisting. The actuator 12 and the contactor 14 are arranged such that force is transmitted between components of the actuator 12 and the contactor 14 substantially in a plane, represented by the broken line 54 in FIG. 2. The plane 54 is substantially perpendicular to the moving blade 22 and the bus-bar 26 of the first contactor member 16 and to the second contactor member 18. In use, the movement of the moving blade 22 is substantially in plane with the force transmission system. The plane 54 comprises a central plane, passing through centroids of the contactor 12 and the actuator 14. In the embodiment shown, the plane 54 passes through a center or central axis of each contactor member 16, 18.

The device 10 is configured to substantially centrally load the force transmission system. A center of the pivotable actuator member 38 is located in the central plane 54. The centroid of the pivotable actuator member 38 is located in the central plane 54.

The device 10 is configured to prevent out of plane forces. The device 10 is configured to substantially transmit all forces in plane 54. The device 10 is configured to prevent pivoting, twisting or torsion of components, such as out of the plane 54. The forces act along the central plane 54 of the device 10. The forces act along a centreline of the device 10.

The actuator arrangement is configured to act upon or transmit force to the first contactor member 16 at a central portion of the contactor member 16. The linear actuator member 46 contacts the moving blade 22 at a central location, equidistant from either edge of the moving blade 22.

The actuator arrangement is configured to force the moving blade 22 towards the ON configuration (e.g. to push). The actuator arrangement is configured to provide a force to the moving blade 22 in the ON configuration to maintain engagement of the contacts 48, 50 between the first and second contactor members 16, 18. The actuator arrangement is configured to force the moving blade 22 towards the OFF configurations (e.g. to pull).

Although not shown, it will be appreciated that the device 10 can be toggled between the ON configuration as shown and the OFF configuration (not shown) by selectively activating the coil 30 to move the linear actuator member 46 relatively up or down to respectively close or separate the contacts 50, 48.

Figure 3:
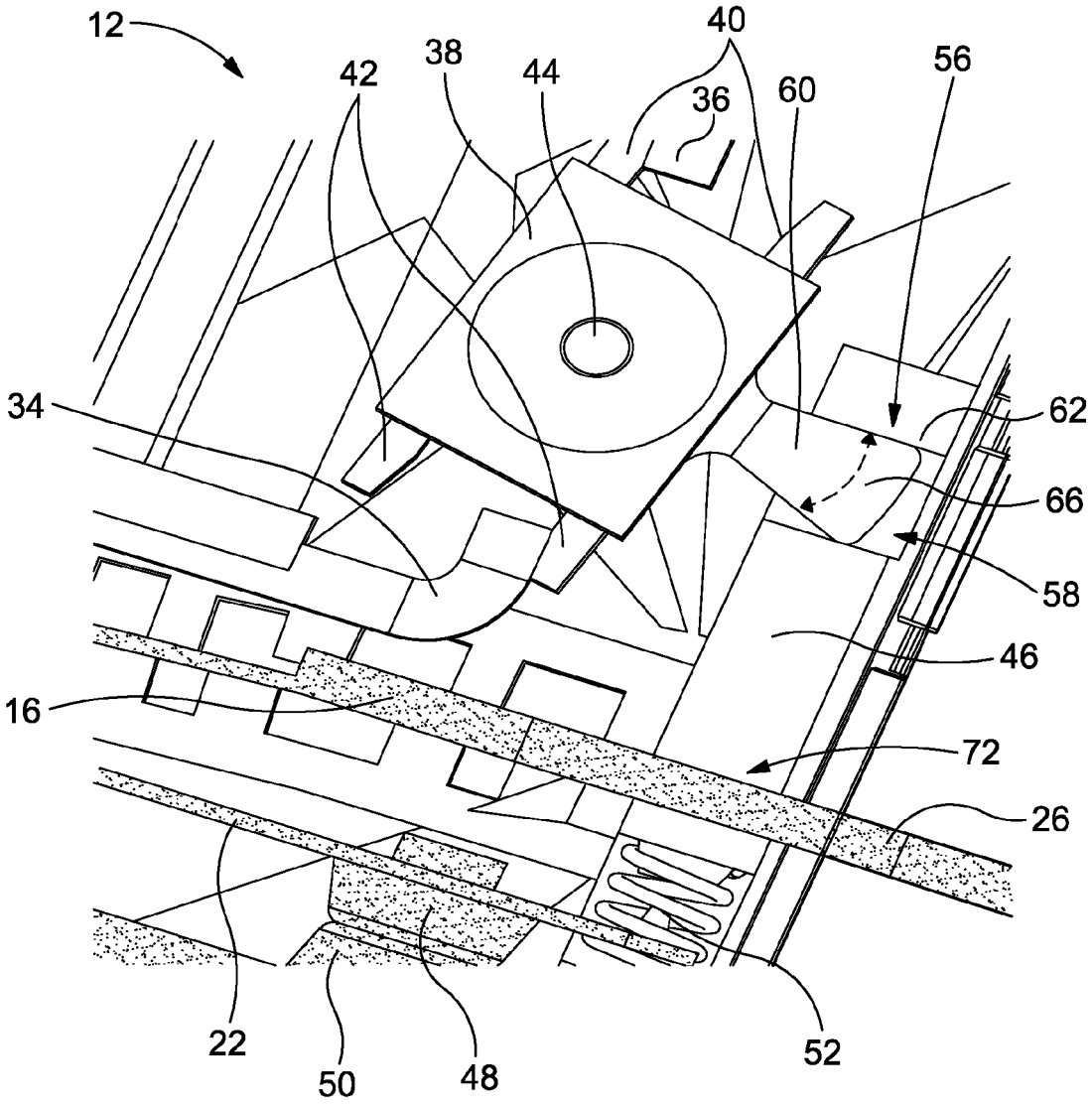
FIG. 3 shows a detail view of a portion of an actuator of the device of FIG. 1.

Reference is now made to FIG. 3, showing a detail view of a portion of the actuator 12. The view shows a partial cross-section.

The pivotable actuator member 38 is configured to cooperate with the linear actuator member 46 to convert a substantially rotational force, such as generated by the coil 30, into a substantially linear force. The actuator 12 comprises an interengaging coupling arrangement 56 between the pivotable actuator member 38 and the linear actuator member 46. In the embodiment shown, the linear actuator member 46 comprises a recess and the pivotable actuator member 38 comprises a corresponding protrusion 60, in the form of a lever arm.

The coupling arrangement 56 is configured to eliminate or at least reduce play between the actuator members 38, 46. Here, the coupling arrangement 56 comprises a snug fit in the ON and OFF configurations; and configurations therebetween.

The coupling arrangement 56 is configured to ensure engagement between the actuator members 38, 46. The coupling arrangement 56 is configured to provide full engagement between the pivotable actuator member 38 and the linear actuator member 46 at all times, such as throughout all movements and/or reconfigurations. The coupling arrangement 56 is configured to provide engagement between the pivotable actuator member 38 and the linear actuator member 46 at the same contact points or surfaces at all times. For example the coupling arrangement 56 comprises a first interface for transferring load between the pivotable and linear actuator members 38, 46 in a first direction of movement, such as a first linear direction of movement; and a second interface for transferring load between the pivotable and linear actuator members 38, 46 in a second direction of movement, such as opposite to the first direction of movement. The coupling arrangement 56 ensures engagement at the first and second interfaces at all times. Each interface comprise contact points or surfaces of the actuator members 38, 46. Engagement comprises contact, such as load-bearing contact.

The coupling arrangement 56 is configured to provide a maximum contact surface area between the linear and the pivotable actuation members 38, 46 at or around the initiation of an actuation, such as a connect and/or a disconnect. Providing a maximum contact surface area may reduce pressure for a given force, such as a maximum force and/or a static force. The coupling arrangement is configured to provide a maximum contact surface area between the linear and the pivotable actuation members 38, 46 in a direction of movement at or around the initiation of an actuation, such as a connect and/or a disconnect.

The coupling arrangement is configured to provide a minimum contact surface area between the linear and the pivotable actuation members 38, 46 in the direction of movement at or around the completion of an actuation, such as a connect and/or a disconnect.

The coupling arrangement 56 is configured to vary the location or position of the maximum and/or minimum contact surface area/s between the linear and the pivotable actuation members 38, 46 according to the direction of travel. The coupling arrangement 56 comprises the first interface for transferring load from the pivotable actuator member 38 to the linear actuator member 46 in the first direction of movement. The second interface is for transferring load from the pivotable actuator member 38 to the linear actuator member 46 in the second direction of movement. The first interface is opposite the second interface. The first interface is located on a first side of the pivotable actuator member 38 (e.g. the first side being in the direction of movement in a first stage or portion of actuation); and the second interface is located on a second side of the pivotable actuator member 38 (e.g. the second side being in the direction of movement in a second stage or portion of actuation or of a different actuation or deactuation). The first direction of movement is in a direction of a connect actuation. The second direction of movement is in a direction of a disconnect actuation, or a deactuation.

The coupling arrangement 56 is configured to provide a maximum contact surface area between the linear and the pivotable actuation members 38, 46 opposite the direction of movement at or around the completion of an actuation, such as a connect and/or a disconnect. Providing a maximum contact surface area opposite the direction of movement towards the completion of an actuation may provide for a reliable and/or consistent and/or accurate positioning of the actuation members 38, 46 upon completion of the actuation. In the embodiment shown a relatively large contact surface area 62 is provided in the direction of movement if the linear actuator 46 were to be moved from the ON configuration of FIG. 3 towards an OFF configuration (not shown). The relatively large contact surface area 62 provides a better alignment between the linear and the pivotable actuation members 38, 46; such as compared to the relatively small contact surface area 64.

The protrusion 60 comprises an angular portion, such as a wedge, in the embodiment shown. The angular portion comprises an angle 66 corresponding to an angle of rotation of the pivotable member 38 between configurations, such as between the On and OFF configurations.

The recess 58 and protrusion 60 each comprise a pair of corresponding engagement surfaces. The coupling arrangement is configured to substantially maintain contact between the corresponding engagement surfaces, such as throughout actuation and/or during periods of ON and/or OFF configurations.

The protrusion 60 is substantially parallel to the first contactor member 16, such as to the moving blade 22. The protrusion 60 is substantially parallel to the first contactor member 60 in a neutral configuration, such as midway between the ON and OFF configurations.

Figure 4:
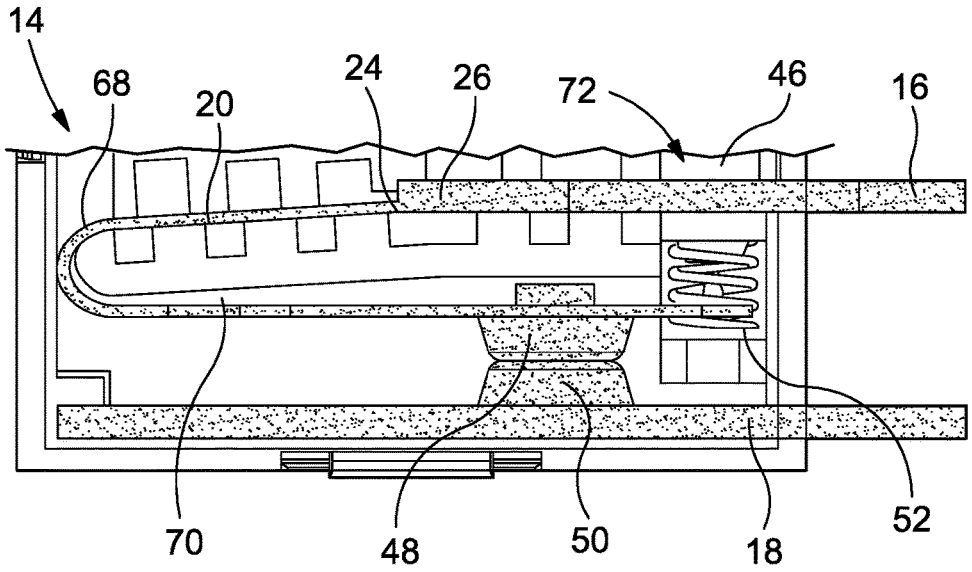
FIG. 4 shows a side view of a portion of a contactor of the device of FIG. 1.

Reference is now made to FIG. 4, which shows a side view of a portion of the device 10, including the contactor 14. The device 10 is configured to minimise a net force between the contacts 50, 48 in response to current flowing (e.g. Lorenz force). The device 10 is configured to generate a similar repulsive force between the moving blade 22 and the first bus-bar 26 and between the moving blade 22 and the second bus-bar 18. The moving blade 22 is substantially equidistant the first and second bus-bars 18, 26 (e.g. the moving blade 22 is positioned halfway between and substantially parallel to each of the first and second bus-bars 18, 26). The moving blade 22 is substantially equidistant the first and second bus-bars 18, 26 in at least the ON configuration, as shown in FIG. 4.

The first contactor member 16 comprises a hinge 68 in the form of a U-bend. Accordingly, the first contactor member 16 comprises a U-shape. The hinge 68 comprises a defined bending radius. The radius provides for a predetermined separation of portions of the first contactor member 16 either side of the hinge 68, such as adjacent the hinge. The radius provides for a similar separation of the moving blade 22 from the first and second bus-bars 18, 26. The hinge 68 defines a virtual pivot axis.

At least a part of the relatively thick portion 26 and at least a part of the relatively thin portion 20 are arranged substantially parallel to each other in the OFF configuration. At least a part of the relatively thick portion 26 and at least a part of the relatively thin portion 20 are angularly offset. The moving blade 22 carrying the contact 48 is angularly offset such that the moving blade 22 and the bus-bar 26 diverge away from the hinge 68 in the ON configuration shown in FIG. 4. Here, the angular offset comprises an angle of about 6°.

Figure 5:
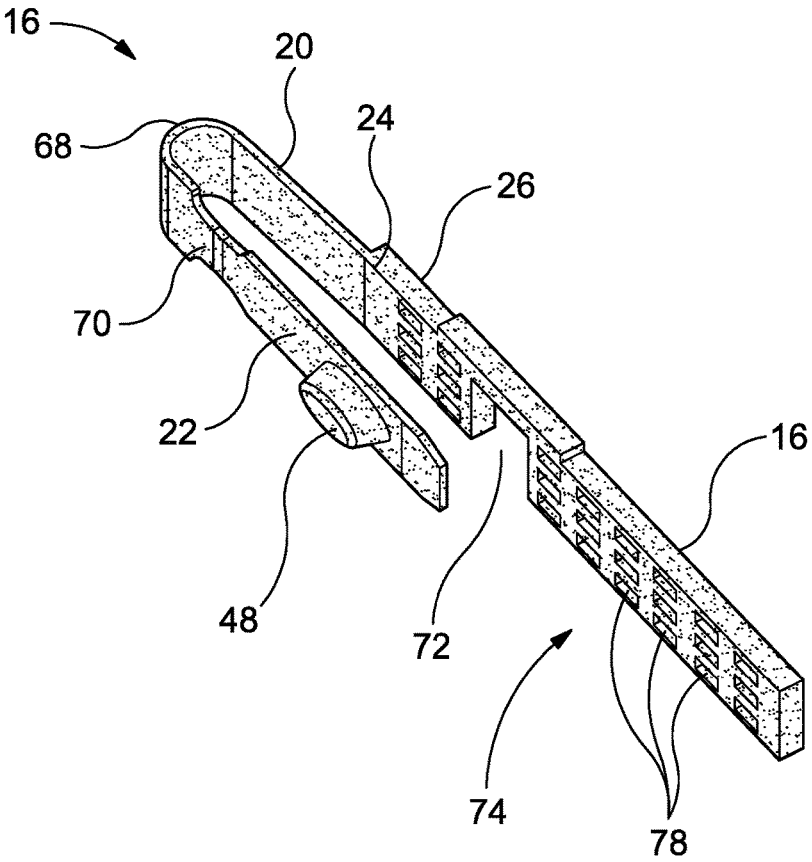
FIG. 5 shows a first contactor member of the device of FIG. 1.

Reference is now made to FIG. 5, which shows the first contactor member 16 in isolation. In the embodiment shown, the first contactor member 16 comprises a second hinge 70 in the form of a portion of reduced stiffness. The second hinge 70 is configured to reduce a required opening force.

The second hinge 70 comprises a portion of increased flexibility. The second hinge 70 comprises a portion of reduced cross-sectional area relative to the thick and thin portions 20, 26 of the first contactor member 16. Increased flexibility may allow the moving blade 22 to deflect easily, such as to allow the contact 48 mounted to the moving blade to oscillate or rock in use (e.g. to prevent welding of the contacts 48, 50).

Here, the portion of increased flexibility comprises a reduced width, such as a necking or a waisting. The first and second hinges 68, 70 are located proximal or adjacent to each other. The portion of reduced stiffness may be located adjacent the U-bend. Here, both the hinges 68, 70 are located distal to the transition portion 24, and are both located in the relatively thin portion 20. The hinges 68, 70 are located between the relatively thick portion 26 and the contact 48.

The hinges 68, 70 provide for a similar deflection at a reduce force. The hinges 68, 70 provide for an increased deflection at a similar force. The hinges 68, 70 allow for a reduced length of the first contactor member 16.

The hinges 68, 70 are located distal to the contact 48 of the first contactor member 16. The contact 48 is located at or towards a free end of the moving blade 22, the free end of the moving blade 22 being distal to the first hinge 68.

In use, the actuator arrangement transmits force to the moving blade 22 distal to the hinges 68, 70. The actuator arrangement is configured to transmit force to the moving blade at a maximum separation from the first hinge 68. The actuator arrangement is configured to transmit force to the moving blade 22 proximal to the contact 48. The actuator arrangement is configured to transmit force to the free end of the moving blade 22, thus maximising leverage.

Here, the relatively thin portion 20 comprises a thickness, such as a nominal thickness, less than or equal to about 30% of the thickness of the relatively thick portion 26. In other embodiments, other thickness ratios may be provided.

The first contactor member 16 comprises the transition portion 24 between the relatively thick portion 26 and the relatively thin portion 20. The transition portion 24 is configured to provide a smooth transfer between the relatively thick portion 26 and the relatively thin portion 20. The transition portion 24 is configured to provide a smooth transfer of electrical load between the relatively thick portion 26 and the relatively thin portion 20. The transition portion 24 is configured to provide a smooth transfer of mechanical load between the relatively thick portion 26 and the relatively thin portion 20. The transition portion 24 is configured to provide a smooth transfer of thermal load between the relatively thick portion 26 and the relatively thin portion 20.

The transition portion 24 and the relatively thick portion 26 and the relatively thin portion 20 are substantially homogenous. In the embodiment shown, the transition portion 24 and the relatively thick portion 26 and the relatively thin portion 20 comprise a similar material in the form of homogenous copper with similar mechanical and electrical and thermal properties.

In alternative embodiments, devices may appear similar to that shown in the Figures. However, the transition portion and/or the relatively thick portion and/or the relatively thin portion may be substantially dissimilar in at least one property. For example, the transition portion and/or the relatively thick portion and/or the relatively thin portion may comprise dissimilar properties from at least one of the other portions. The dissimilar property/ies may comprise a type of material and/or a mechanical property and/or an electrical property and/or a thermal property. For example, in other embodiments, the contactor member comprises a bimetallic contactor member, such as with copper in the relatively thick portion and a copper alloy (e.g. copper/zirconium alloy or the like) in the relatively thin portion.

The relatively thick portion 26 and the relatively thin portion 20 are axially aligned at the transition portion such that the relatively thin portion 20 is an axial extension of the relatively thick portion 26.

The transition portion 24 comprises a chamfer. The transition portion 24 is configured to prevent peeling of the relatively thin portion 20 from the relatively thick portion 26. The first contactor member 16 is configured to substantially tensionally or compressively load the transition portion 24.

The transition portion 24 is comprises a fused portion, formed by electron beam welding. In the embodiment shown, the transition portion 24 comprises a lap connection between the relatively thin portion 20 and the relatively thick portion 26. In other embodiments, the transition portion comprises a butt connection, such as a butt fusion.

The device 10 is configured to allow the actuator 12 to act directly on a central portion of the first contactor member 16. The device 10 is configured to allow the actuator arrangement to act directly on the moving blade 22. The first contactor member 16 comprises a slot or opening 72 to allow the actuator arrangement to pass through. The opening 72 is centrally located in the contactor member 16. The opening 72 allows the actuator arrangement to pass through centrally. The opening 72 allows the aperture arrangement to transmit force to the first contactor member 16 substantially linearly, with the linear actuator member 46. The opening 72 allows the linear actuator member 46 to transmit force internally centrally. The opening 72 allows the linear actuator member 46 to transmit force directly to the moving blade 22. The opening 72 allows the linear actuator member 46 to be substantially purely compressively or tensionally loaded.

Figure 6:
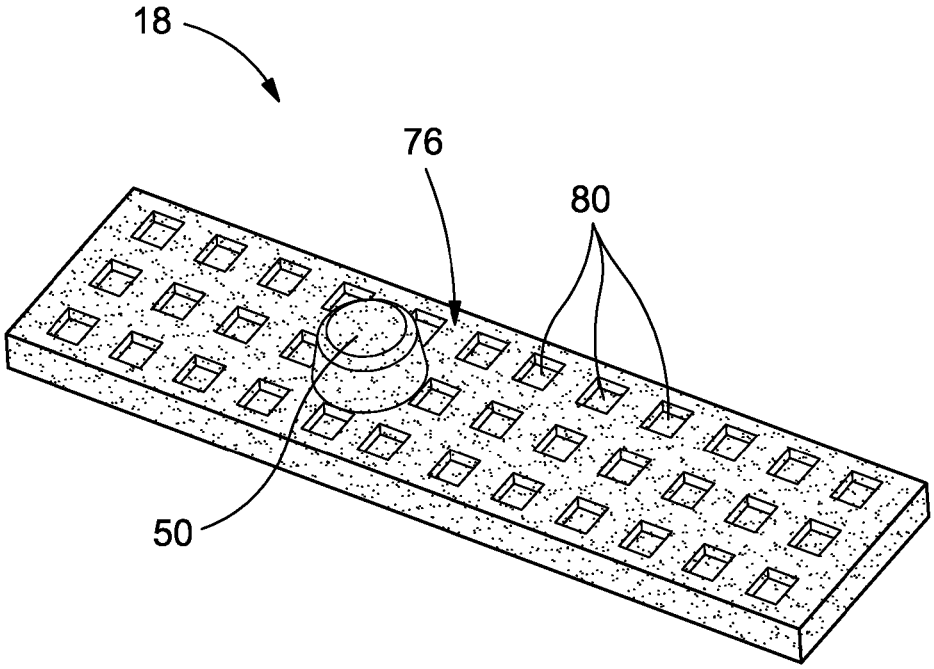
FIG. 6 shows a second contactor member of the device of FIG. 1.

Reference is now made to FIGS. 5 and 6. FIG. 6 shows the second contactor member 18 in isolation. The first and second contactor members 16, 18 are configured to dissipate heat at an increased rate.

The first and second contactor members 16, 18 comprise increased surface areas. The first and second contactor members 16, 18 comprise surface areas of at least one side or face 74, 76 that are substantially greater than the footprint and/or planar projection of said side or face 74, 76.

The surface areas of the at least one side or face 74, 76 are substantially discontinuous. The surface areas of the at least one side or face 74, 76 are configured to dissipate substantially more heat than an equivalent continuous or planar surface. The first and second contactor members 16, 18 comprise non-uniform and non-homogenous and asymmetrical and anisotropic cross-sections at at least one portion.

The first and second contactor members 16, 18 comprise a plurality of recesses 78, 80 longitudinally and laterally arranged along and perpendicular to a longitudinal axis of the contactor member, in the at least one side or face 74, 76. In the embodiment shown, the recesses 78, 80 comprise blind recesses, in the form of indentations or depressions. In other embodiments, the recess comprises a continuous recess. For example, the recess comprises a continuous slot, such as a serpentine or a labyrinthine slot. In other embodiments, the contactor member/s comprise protrusions in addition or alternatively to recesses.

In the embodiment shown, cross-sections of the first and second contactor members 16, 18 comprise a variable thickness, such as parallel and perpendicular to a longitudinal axis of the contactor members 16, 18. The recesses 78, 80 do not have corresponding protrusions in faces opposing the increased surface area faces 74, 76.

Here, each contactor member 16, 18 comprises an internal portion within the housing 28 and an external portion outside the housing 28. The relatively thick portion 26 comprises internal and external portions. The internal and external portions are configured to dissipate heat at the increased rate. The internal and the external portions of the first and second contactor members 16, 18 comprise the sides or faces 74, 76 with the surface area that is substantially greater than the footprint and/or planar projection of said side or face 74, 76.

In the embodiment shown the second contactor member 18 comprises a static contactor member in the form of a fixed bus-bar. In other embodiments, the second contactor member is substantially similar to the first contactor member 16; such as comprising a bus-bar 26 and a moving blade 22.

Here, the switching device 10 comprises a remote disconnect switching device, such as a remotely-operable or remotely-operated disconnect switching device. The switching device 10 comprises a disconnect relay, such as for a smart meter. The switching device 10 comprises a switching device for connecting and/or disconnecting a power load from a voltage source, such as from AC mains electricity. The switching device 10 comprises a high current switching device. The switching device 10 is configured to withstand a short circuit load, such as thirty times the nominal load. The switching device 10 comprises a domestic or residential electricity switching device. The switching device 10 comprises a cyclical switching device, rated and/or suitable for at least 5000; at least 10000; at least 15000 operating cycles respectively, such as electrically operating cycles.

Other switching devices may be suitable for kiloampere loads; such as for 6000 Amps or more. Other switching devices comprise an industrial electricity switching device. Other switching devices comprise a DC switching device, such as for low voltage sources (e.g. for vehicle batteries).

It will be appreciated that any of the aforementioned apparatus may have other functions in addition to the mentioned functions, and that these functions may be performed by the same apparatus.

The applicant hereby discloses in isolation each individual feature described herein and any combination of two or more such features, to the extent that such features or combinations are capable of being carried out based on the present specification as a whole in the light of the common general knowledge of a person skilled in the art, irrespective of whether such features or combinations of features solve any problems disclosed herein, and without limitation to the scope of the claims. The applicant indicates that aspects of the present invention may consist of any such individual feature or combination of features. It should be understood that the embodiments described herein are merely exemplary and that various modifications may be made thereto without departing from the scope of the invention. For example, it will be appreciated that although shown here as continuous, the moving blade may comprise a bifurcation/s. Although shown hear as planar, other embodiments of contactor member may be curved, such as convex and/or concave.

The invention claimed is:

1. A switching device comprising:

a contactor comprising at least a first contactor member and a second contactor member; and an actuator configured to actuate the contactor, wherein at least one of the first and second contactor members comprises a bus-bar and a moving blade, wherein the bus-bar is electron beam welded to the moving blade, and wherein the switching device is a mains electricity smart meter remotely-operated switching device.

2. The switching device of claim 1, wherein the-bus-bar is configured to dissipate heat at an increased rate by comprising a surface area of at least one face that is substantially greater than the footprint and planar projection of said face, and the at least one contactor member comprises at least one of:

a plurality of protrusions in the at least one face; and a plurality of recesses in the at least one face.

3. A method of-connecting the moving blade of the contactor member of the switching device of claim 1, the method comprising-electron beam welding the moving blade to the bus-bar.

4. The switching device of claim 1, wherein the contactor member comprising the bus-bar and the moving blade is a single unitary piece, wherein the bus-bar and the moving blade are integral.

5. The switching device of claim 1, comprising an aligned force transmission system configured to balance forces transmitted between the actuator and the contactor.

6. The switching device of claim 5, wherein the actuator and the contactor are arranged such that force is transmitted between components of the actuator and the contactor substantially in a plane.

7. The switching device of claim 1, wherein the bus-bar and moving blade are substantially continuous.

8. The method of claim 3, comprising transmitting forces between the actuator and contactor of the switching device through an aligned force transmission system.

9. The method of claim 8, comprising arranging the actuator and the contactor such that force is transmitted between components of the actuator and the contactor substantially in a plane.

10. The method of claim 3, comprising dissipating heat from the bus-bar at an increased rate by providing a surface area of at least one side or face of the bus-bar that is substantially greater than the footprint and the planar projection of said side or face.

11. A switching device comprising:

a contactor comprising at least a first contactor member and a second contactor member; and an actuator configured to actuate the contactor, wherein at least one of the contactor members comprises a first, thick portion, which is thick relative to a second, thin portion, wherein the thick portion comprises a bus-bar and the thin portion comprises a moving blade, and wherein the bus-bar and the moving blade are homogenous, both comprising a same homogeneous property of at least one of: an electrical property; and a thermal property.

12. The switching device of claim 11, wherein the switching device is a mains electricity smart meter remote disconnect switching device.

13. The switching device of claim 11, wherein the bus-bar is configured to dissipate heat at an increased rate.

14. The switching device of claim 13, wherein the bus-bar comprises a surface area of at least one side or face that is substantially greater than the footprint and planar projection of said side or face.

15. The switching device of claim 11, comprising an aligned force transmission system configured to balance forces transmitted between the actuator and the contactor.

16. The switching device of claim 15, wherein the actuator and the contactor are arranged such that force is transmitted between components of the actuator and the contactor substantially in a plane.

17. The switching device of claim 11, wherein the bus-bar and the moving blade comprise a similar type of material and a similar electrical property and a similar thermal property.

18. The switching device of claim 11, wherein the at least one of the contactor members does not comprise a boundary between the bus-bar and the moving blade.

19. The switching device of claim 11, wherein the at least one of the contactor members is a continuous integral unitary contactor member of variable thickness, the moving blade and the bus-bar comprising at least one continuous surface extending from the bus-bar to the moving blade.

* * * * *